United States Patent [19]

Wong

[11] 4,003,804

[45] Jan. 18, 1977

[54] METHOD OF ELECTROPLATING OF ALUMINUM AND PLATING BATHS THEREFOR

[75] Inventor: Jack Yea Wong, San Jose, Calif.

[73] Assignee: Scientific Mining & Manufacturing Company, Arroyo Grande, Calif.

[22] Filed: Dec. 31, 1975

[21] Appl. No.: 645,552

[52] U.S. Cl. ..... 204/14 N

[51] Int. Cl.[2] ..... C25D 3/44

[58] Field of Search ..... 204/14 R, 14 N, 39

[56] References Cited

UNITED STATES PATENTS

| | | | |
|---|---|---|---|
| 2,170,375 | 8/1939 | Mathers et al. | 204/14 N |
| 3,775,260 | 11/1973 | Capuano et al. | 204/14 N |

OTHER PUBLICATIONS

Electrodeposition of Aluminum from Non-Aqueous Solutions, R. D. Blue et al., J. Elect. Sol. Preprint 65-2, Apr. 30, 1934, pp. 25-38.

*Primary Examiner*—T. M. Tufariello
*Attorney, Agent, or Firm*—I. Morley Drucker

[57] ABSTRACT

Two improved methods are described for the electrodeposition of aluminum or an alloy thereof onto an electrically conducting, preferably metallic, substrate which methods comprise:

a. reacting aluminum with hydrogen halide (preferably hydrogen bromide) in the absence of water, and in an aromatic hydrocarbon solvent (toluene) to form a plating hydro aluminum halide cation in solution, the concentration of the plating aluminum cation and the concentration of hydrogen ion, in solution being, respectively, below 7.5M and 1.1M and preferably below 4.2M and 0.5M. Various bromine getters are bubbled or passed through the region of the anode, to react with bromine produced, and to prevent attack of the plated aluminum by the bromine produced, or, alternatively.

b. reacting aluminum with hydrogen halide (preferably hydrogen bromide) in an aromatic hydrocarbon solvent to form an anhydrous plating, hydro aluminum bromide cation, in solution, of the type set forth in (a) above, and then adding an alkyl halide to form a different plating species, the amount of alkyl halide added being preferably a small percentage of the amount of aromatic solvent employed.

Also, the method of directing the said solutions to a separate electroplating zone and depositing aluminum on a cathode using an inert anode is described.

31 Claims, 2 Drawing Figures

METHOD OF ELECTROPLATING OF ALUMINUM AND PLATING BATHS THEREFOR

BACKGROUND OF THE INVENTION

The present invention relates to the plating of aluminum or its alloys onto an electrically conductive substrate serving as the cathode in an electrolytic cell. More specifically, it relates to the formation of an inexpensive and effective electroplating solution which can be employed for electroplating from solution using an inert anode.

Scientists have known for a long time that aluminum cannot be electrodeposited successfully from aqueous solutions of its salts because electrolysis merely results in the decomposition of the water present in the electrolyte. This is true since the potential necessary for the deposition of aluminum is much in excess of that necessary for the liberation of hydrogen.

A number of processes have been reported in the literature in which aluminum is plated from a bath containing aluminum compounds in organic solutions. The processes disclosed are: U.S. Pat. No. 2,170,375 issued Aug. 22, 1939 to Mathers et al., U.S. Pat. No. 2,763,605 issued Sept. 18, 1956 to Miller et al., U.S. Pat. No. 3,355,368 issued Nov. 28, 1967 to Smith et al., U.S. Pat. No. 2,651,608 issued Sept. 8, 1953 to Brenner et al., U.S. Pat. No. 3,775,260 issued Apr. 27, 1971 to Capuano et al., as well as articles entitled "Electrolytic Precipitation of Aluminum from Solutions of Aluminum Bromide in Xylene" by A. Levinskene and L. Simana Vichyus, in *Scientific Works of the Universities of the Lithuanian SSR Chemistry and Chemical Technology* VII (1965); and "The System Benzene-Hydrogen Bromide-Aluminum Bromide" by Eley and King, J. Chem Soc., 2517 (1952). However, the processes cited in the above references have major disadvantages.

The Mathers work as discussed in U.S. Pat. No. 2,170,375 for example, does not result in efficient plating, and it found that, because of the concentrations and ratios of the various reagents employed by Mathers, that plating of aluminum, even at high voltages, is sporadic and, in many instances, non-existent. Capuano confirms this, in his discussion of the Mathers work, in U.S. Pat. No. 3,775,260. Further, Mathers uses preformed aluminum bromide which is very expensive, in scarce supply, and difficult to work with because it picks up water readily from the atmosphere. The water then reacts with the aluminum bromide to form aluminum oxide; thus aluminum is not available for the plating operation.

Another disadvantage of Mathers, is his use of an aluminum anode. If any oxide on the surface of the aluminum anodewere not to be removed evenly, spots of highly insulative aluminum oxide would remain on the anode, and regions on the cathode corresponding to these spots would be plated only to a relatively low degree. Also, metallic impurities in the aluminum anode may plate in preference to aluminum.

With regard to the relatively recent Capuano et al., U.S. Pat. No. 3,775,260, it is stated that a small amount of water is necessary in the solution for conducting purposes. The presence of water, however, leads to the copious evolution of HBr fumes during electrolysis, and the aluminum which plates on the substrate is a dull grey and somewhat brittle. Furthermore, the process requires the use of an expensive ethylbenzene which is consumed during electrolysis.

In general, processes cited above have not achieved commercial success because the electrolytic baths have normally been unstable; often contain inflammable or possibly explosive organic materials, and are usually toxic, complex, and relatively expensive to formulate. Since such solutions in general are not too conductive, it has been found necessary to employ either a volatile solvent such as ether or a compound which evolves copious quantities of a poisonous gas. Such baths are hazardous to work with. In addition, the plated aluminum is usually not high quality, being dull and brittle and not very adherent to the substrate.

SUMMARY OF THE INVENTION

This invention provides an economical system for sequentially forming an electroplating solution and thereafter directing the same to an electrolytic cell for plating from solution using an inert anode. Preferably, all of the aluminum to be plated is complexed while forming the plating solution so that an inert anode is employed, thereby avoiding the disadvantages of prior art processes which employ aluminum anodes. The electroplating solutions of this invention are relatively inexpensive and easy to handle.

Two improved methods are described for the electrodeposition of aluminum or an alloy thereof onto an electrically conducting, preferably metallic, substrate which methods comprise:

a. reacting aluminum with hydrogen halide (preferably hydrogen bromide) in the absence of water, and in an aromatic hydrocarbon solvent (toluene) to form a plating hydro aluminum halide cation in solution, the concentration of the plating aluminum cation and the concentration of hydrogen ion, in solution being, respectively, below 7.5M and 1.1M and preferably below 4.2M and 0.5M. Various bromine getters are bubbled or passed through the region of the anode, to react with bromide produced, and to prevent attack of the plated aluminum by the bromine produced; or alternatively.

b. reacting aluminum with hydrogen halide (preferably hydrogen bromide) in an aromatic hydrocarbon solvent to form an anhydrous plating, hydro aluminum bromide cation, in solution, of the type set forth in (a) above, and then adding an alkyl halide to form a different plating species, the amount of alkyl halide added being preferably a small percentage of the amount of aromatic solvent employed.

Also, the method of directing the said solutions to a separate electroplating zone and depositing aluminum on a cathode using an inert anode is described.

DETAILED DESCRIPTION OF THE PREFERRED EMBODIMENTS

Figure 1:
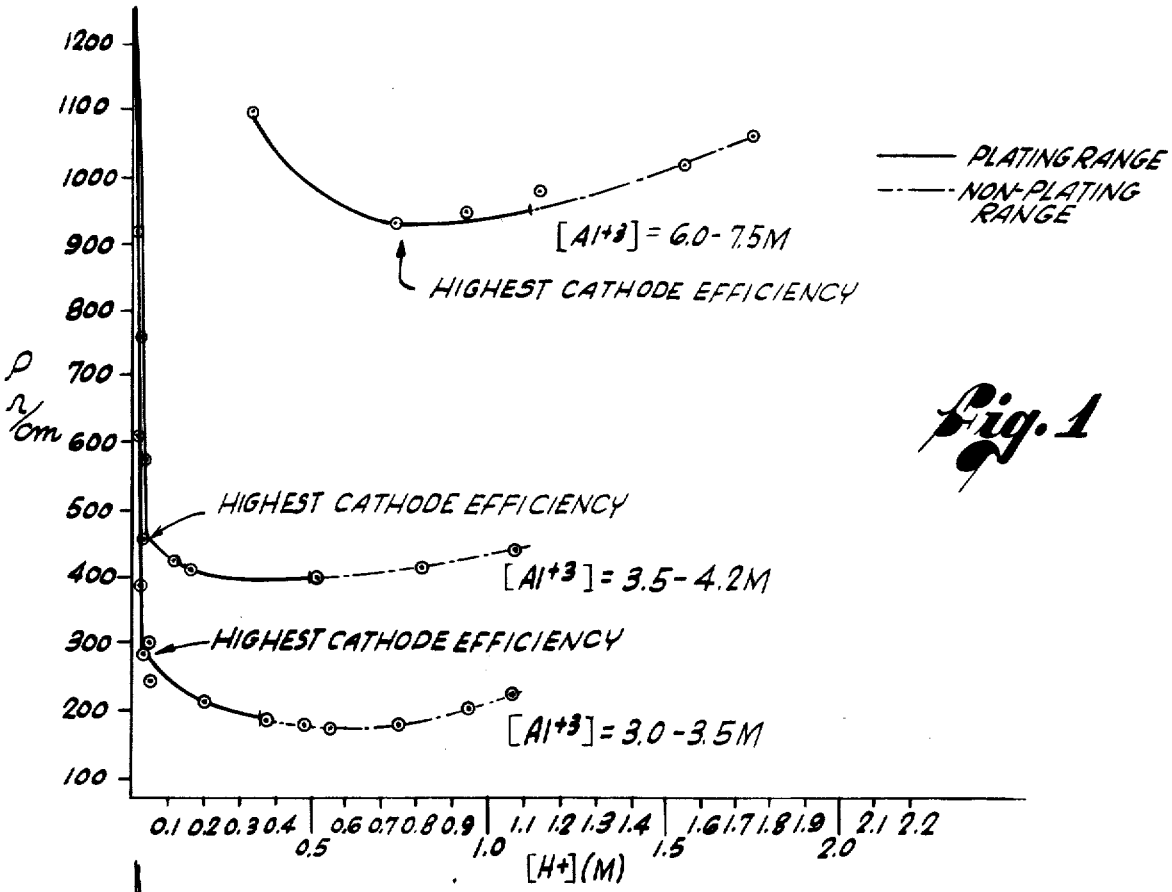
FIG. 1 shows curves of resistivity of electroplating solutions versus hydrogen ion (H+) concentration, for various concentrations of aluminum ion, in the Toluene-Hydrogen Bromide-Aluminum Bromide System.
Figure 2:
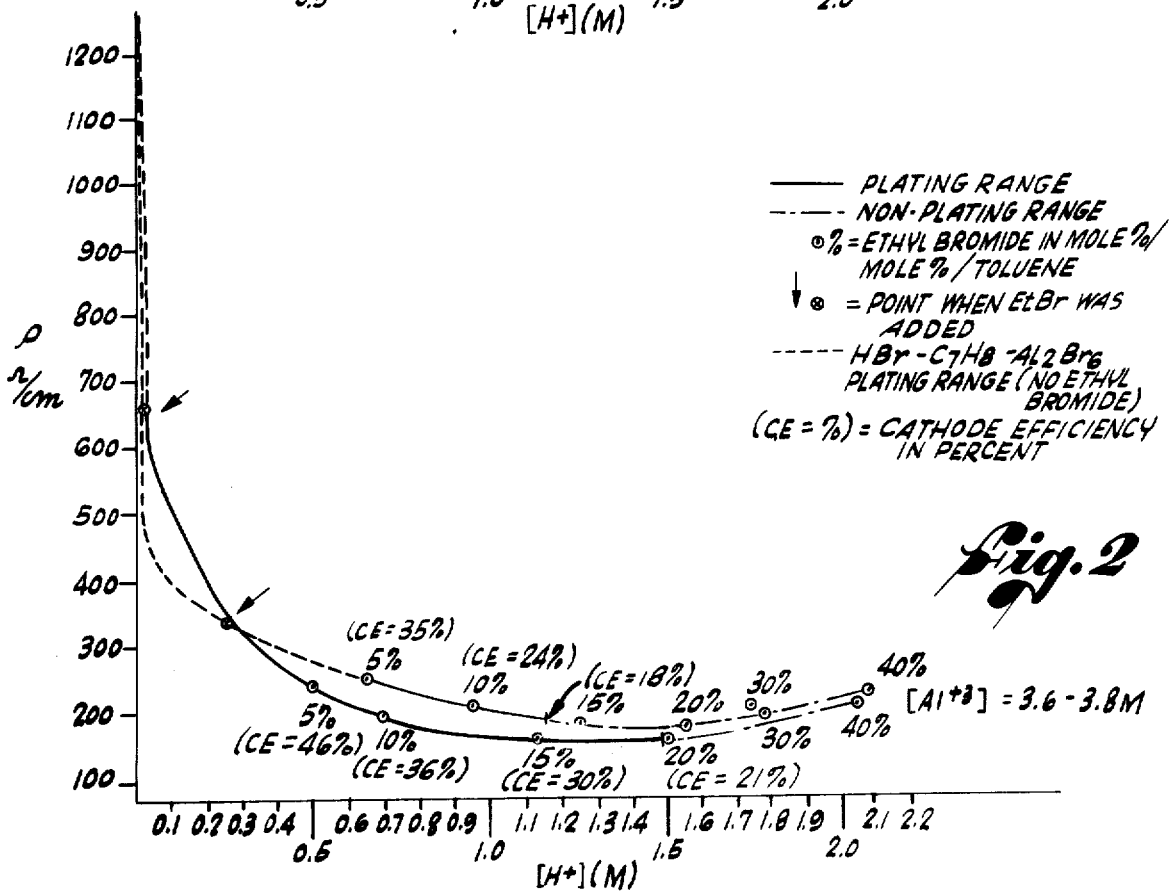
FIG. 2 shows curves of resistivity of electroplating solutions versus hydrogen ion concentrations, and for various concentrations of aluminum ion, in the Toluene-Hydrogen Bromide-Aluminum Bromide-Ethyl Bromide System.

PART 1 — The System:Toluene-Hydrogen Bromide — Aluminum Bromide

It has now been found that aluminum may be electrodeposited from a relatively inexpensive, conductive, stable organic electrolyte to produce a bright, adherent, ductile deposit of aluminum onto an electrically conducting metal substrate. One of the electrolytes of the present invention comprises a solution of aluminum, hydrogen halide (preferably bromide) and an aromatic solvent, preferably toluene. This plating solution, preferably in anhydrous form, is then directed to an electrolytic cell in which the aluminum is electrolytically deposited on an electrically conducting metal substrate. Preferably, all of the aluminum to be plated is complexed while forming the plating solution so that an inert anode is employed thereby avoiding the disadvantages of prior art processes which employ aluminum anodes, The reaction zone includes one or more reactors upstream of the electrolytic cell in which the basic reagents have been thoroughly mixed and reacted.

The particular solvent employed should be one in which the hydro-aluminum bromide cation is relatively soluble, and which does not contain groups which would provide competing reactions in the system. For this purpose, it has been found that toluene is the least expensive and most convenient solvent due to its relatively low viscosity. Other aromatic solvents which may be employed include benzene, xylene, ethyl benzene, diethyl benzene, mesitylene, and other methylated, ethylated, or alkyl benzenes. Labile nitrogen, oxygen, and sulfur groups are to be avoided in the solution because of their potential for competing reactions. It is preferable to maintain the viscosity at a relatively low level to avoid problems of pumping the solution. This can be accomplished by dissolving only an adequate amount of aluminum; i.e., the concentration of aluminum bromide in solution should be from about 3.0M to about 4.2M and optimally, between about 3.5–4.2M, while plating can be accomplished with an aluminum bromide concentration of as high as 7.5M, or higher, the viscosity is much higher than necessary for optimal plating.

The preferable halide is bromide as set forth herein. Thus, for simplicity of description, the remainder of the application refers to bromide as the halide. A major advantage of using hydrogen bromide rather than hydrogen chloride or iodide as the reactant with the aluminum to form aluminum bromide is its relatively high solubility in organic solvents at room temperature. For example, the solubility of aluminum bromide in toluene at 20° C is 42.5 gm/100 gm of solvent in comparison to aluminum chloride with a solubility of 0.3 gm/100 gm. A disadvantage of using hydrogen iodide in the above reaction is its relative instability and tendency to deposit a solid non-conductive layer on the anode.

The hydrogen bromide serves two important functions in the above system. Firstly, it enters into the reaction with aluminum to form aluminum bromide in complex form in situ (see Equation I below). Also, sufficient stoichiometric excess over that required for the above reaction is provided to increase the conductivity (or lower the resistivity) of the solution to acceptable levels for commercial plating operations (Equation II).

The first-step reaction appears to proceed according to the following equation:

$$2\,Al + ArH + 6HX \rightarrow [Al_2X_5.ArH]^+ + X^- + 3H_2 \qquad (I)$$

wherein Ar is an aromatic hydrocarbon, preferably toluene; X is a halogen, preferably bromide; and $[Al_2X_5.ArH]^+$ is a plating ($\pi$) complex cation.

In the second stage of the reaction, the hydrogen bromide is reacted with the $\pi$ complex cation to form a cationic hydro-aluminum bromide complex, i.e. a complex cation which is capable of plating aluminum:

$$HX + {}_2^3\,[{}^4/_2X_5.ArH]^+ \rightarrow [Al_2X_4H.ArH]^+ + AlX_4^- \qquad (II)$$

It has been found that in the Toluene-Hydrogen Bromide-Aluminum Bromide plating system, too high a concentration of hydrogen bromide in solution appears to prevent plating of aluminum. This may be due to the fact that the plated aluminum is removed by the hydrogen bromide as rapidly as the aluminum is plated. As illustrated in FIG. 1, the amount of hydrogen bromide in solution with regard to a plating solution depends on the concentration of dissolved aluminum bromide. For example, when the aluminum concentration is from 3.5M to 4.2M, optimal plating has been found when the hydrogen bromide concentration is less than 0.1M. No plating is observed when the hydrogen bromide concentration is greater than 0.5M. On the other hand, the plating range of a 6.0M to 7.5M aluminum bromide solution is maintained in as high as a 1.1M hydrogen bromide concentration. However, the higher concentrations of aluminum bromide solutions tend to be very viscous; and these solutions are normally low in conductivity. Thus, these solutions require plating at higher voltages, and sometimes problems of pumping arise. Hence, the optimal plating solution of the Toluene-Hydrogen Bromide-Aluminum Bromide System contains the following parameters:

1. The aluminum bromide concentration is from about 3.0M to about 4.2M;
2. The hydrogen bromide concentration is less than about 0.1M, but preferably lies in the range of from about 0.01M – 0.1M and can, in some instances, be as high as 0.5M;
3. The resistivity of the solution is from about 250 to 500 ohm-centimeters;
4. The best cathode efficiency is 100%; and
5. The best current density is about 35 milliamperes per square centimeter.

A solution of the foregoing type is then directed to an electroplating cell in which the following reaction occurs at the cathode:

$$[Al_2Br_4H.ArH]^+ + 3e^- \rightarrow 2Al^0 + Arh + HBr + Br_3^- \qquad (III)$$

In construction of the cell, the cathode may comprise any electrical conductive material upon which aluminum is to be plated. For example, for use in lead frames in the semi-conductor industry, the cathode may comprise Kovar (a nickel-iron allow such as carpenter alloy 42) comprising 42% nickel. As set forth above it is preferable to use an "inert" or "passive" anode, such as graphite or platinum. This avoids the aforementioned problems of using an aluminum anode. By use of an inert anode, the electrolyte from the above reactor zone can be purified before passage into the electrolytic cell to remove any insoluble sludges or soluble impurity metals.

One means for lowering voltage drop across the plating is to position the anode and cathode relatively close such as within 0.030 inch or less. This can be assisted by using a porous anode, e.g., porous graphite, through which the electrolytic solution passes.

In the zone of electroplating, the following reactions can occur at the anode:

$$[AlBr_4]^- \rightarrow Br_2 + e^- \quad (IV)$$
$$Br_2 + Br^- \rightarrow Br_3^- \quad (V)$$

Bromine in either form is highly reactive with aluminum, and will attack the aluminum which has been plated unless it is removed from the system. For this purpose, a bromine getter, preferably an oxidizing agent is present. Theoretically, hydrogen may be bubbled through the system in the region of the anode to react with the bromine to form hydrogen bromide as illustrated below:

$$AlBr_4^- + \tfrac{1}{2} H_2 \rightarrow HBr + e^- \quad (VI)$$
$$Br_3^- + \tfrac{1}{2} H_2 \rightarrow HBr + BR_2 \quad (VII)$$

A bromine getter of another type is the aromatic organic solvents of toluene, ethyl benzene, or other alkyl benzenes, which react as follows:

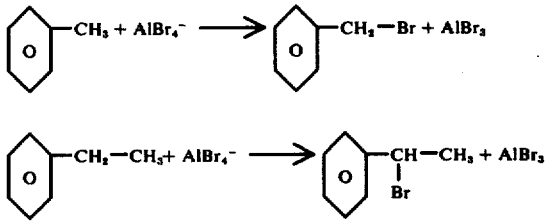

(VIII)

(IX)

It has been found that the Toluene-Hydrogen Bromide-Aluminum bromide system herein described plates effectively at a rate of from 10 to 20 minutes at voltage drops on the order of 2 to 3 volts and a current density of 35 milliamperes per square centimeter. Under these conditions for a 10 minute plating, the maximum thickness of plating is 360 micro inches.

PART II — The System: Ethyl Bromide-Toluene-Hydrogen Bromide-Aluminum Bromide An alternative method and plating bath to that described in Part I hereof, is here set forth. It is to be understood that the process and plating baths described in Part I are presently preferred because of their relative low cost, simplicity, and high efficiency.

The Ethyl Bromide-Toluene-Hydrogen Bromide-Aluminum Bromide system comprises a solution of aluminum, hydrogen halide (preferably bromide), alkyl halide (preferably ethyl bromide), and an aromatic solvent, preferably toluene. This plating solution, preferably in anhydrous form, is then directed to an electrolytic cell in which the aluminum is electrolytically deposited on an electrically conducting metal substrate. Preferably, all of the aluminum to be plated is complexed while forming the plating solution so that an inert anode is employed thereby avoiding the disadvantages of prior art processes which employ aluminum anodes. By employing an anhydrous system instead of using hydrous aromatic solvents as in the case of some prior art processes, the copious evolution of HBr fumes is avoided during plating.

The advantages of using certain concentration limits of toluene, hydrogen bromide, aluminum bromide, and an inert anode in this plating system are described in detail in Part I. It has been found that optimal plating is achieved if the aluminum halide (bromide) is first complexed with the aromatic solvent (toluene) with a proper concentration of hydrogen halide (bromide) as described in Part I before the alkyl halide (ethyl bromide) is added. If the alkyl halide (ethyl bromide) is added at the beginning of the reaction, side reactions may occur, which contaminates the plating solution with other complexes such as ethyltoluene from Friedel-Crafts side reactions, and with other impurities such as $AlHBr_2$, $AlH_2Br$, etc.

The first-step reaction proceeds according to the following:

$$2Al + ArH + 6HX \rightarrow [Al_2X_5.ArH]^+ + X^- + 3H_2 \quad (X)$$

wherein Ar is an aromatic hydrocarbon, preferably toluene and X is a halogen, preferably bromide. $[Al_2X_5.ArH]^+$ is a $\pi$ complex cation.

In the second stage of the reaction, it is believed that the ethyl bromide is reacted with the aluminum bromide portion of the $\pi$ complex cation to form a cationic ethylaluminum bromide complex, which is capable of being plated.

$$RX + 3/2[Al_2X_5.ArH]^+ \rightarrow [RAl_2X_4.ArH]^+ + AlX_4^- \quad (XI)$$

wherein RX is an alkyl halide, preferably ethyl bromide

Suitable alkyl groups for use as the alkyl bromide reagent in the above reaction includes the lower ones in the series: ethyl, methyl, n-propyl and isopropyl groups. With the alkyl moiety higher in the series, the solubility of the alkyl bromide and the corresponding alkyl aluminum bromide complex is decreased to less desirable levels. Ethyl bromide is preferred over methyl bromide because methyl bromide is a gas at room temperature, and hence, is more difficult to form the methyl aluminum bromide cation at room temperature.

Similarly to the Toluene-Hydrogen Bromide-Aluminum Bromide system described in Part I, a large excess in concentration of hydrogen bromide is harmful to the plating quality in the Ethyl Bromide-Toluene-Hydrogen Bromide-Aluminum Bromide system also. Only a stoichiometric excess in concentration of hydrogen bromide beyond what is required to form the toluene-aluminum bromide complex is required for conductive purposes. As ethyl bromide is added dropwise to the prepared toluene-hydrogen bromide-aluminum bromide complex, hydrogen bromide gas is evolved. The amount of ethyl bromide necessary to form the ethylaluminum bromide plating cation depends on the concentration of HBr in solution prior to the addition of ethyl bromide. As illustrated in FIG. II, if the toluene-aluminum bromide complex contains 0.05M HBr in solution with resistivity equal to 650 ohm-centimeters, the plating range of the final ethylaluminum bromide solution goes up to 20 mole percent ethyl bromide relative to toluene (or 80 mole % toluene). Optimal plating using this solution has been found with the ethyl bromide reagent at 8 mole % relative to 92 mole % toluene.

On the other hand, if the original toluene-aluminum bromide complex contains 0.30 M HBr in solution with the resistivity at 340 ohm-centimeters, plating will result in the final ethylaluminum bromide solution if the ethyl bromide concentration is less that 14 mole % relative to toluene (or 86 mole % toluene). The optimal plating of this solution has been found with the ethyl bromide concentration at 4 mole % relative to 96 mole % toluene. Hence, it appears that the optimal plating solution of Ethyl Bromide-Toluene-Hydrogen Bromide-Aluminum Bromide system should contain the following parameters:

1. The aluminum bromide concentration is from about 3.6M to about 3.8M;
2. The initial hydrogen bromide concentration prior to the addition of ethyl bromide is from about 0.05M to about 0.10 M, with the resistivity from 650 to 750 ohm-centimeters;
3. The resistivity of the final ethylaluminum bromide solution is from 200 to 250 ohm-centimeters;
4. The ethyl bromide concentration is from 7 to 10 mole % relative to toluene although if 0.05 M HBr is initially present, as much as 20 mole percent ethyl bromide can be present;
5. The best cathode efficiency is 47%; and
6. The best plating current density is 70 milliamperes per square centimeter.

A solution of the foregoing type is than directed to an electroplating cell in which the following reaction occurs at the cathode:

$$[RAl_2Br_4.ArH]^+ \rightarrow Al^\circ + \ldots \quad \text{(XII)}$$

As in the case of the Toluene-Hydrogen Bromide-Aluminum Bromide system in Part I, in the zone of electroplating the following reactions can occur at the anode:

$$[Al\,Br_4]^- \rightarrow Br_2 + e^- \quad \text{(XIII)}$$

$$Br_2 + Br^- \rightarrow Br_3^- \quad \text{(XIV)}$$

As mentioned in Part I, a bromine getter is necessary in the zone of electroplating to remove this highly reactive by-product from attacking the plated aluminum on the cathode. The bromine getter may be in the form of dissolved hydrogen as illustrated in equation (VI); or it may be in the form of the organic aromatic solvent itself as illustrated by equations (VIII) and (IX).

It has been found that the Ethyl Bromide-Toluene-Hydrogen Bromide-Aluminum Bromide system plates effectively at a rate from 10 to 20 minutes at voltage drops on the order of 3.0 volts and a current density of 70 milliamperes per square centimeter. Under these conditions for a 10 minute plating, the maximum thickness of plating has been found to be about 285 microinches.

Each of the aforementioned two systems provide an efficient two-stage process, which can be adapted for an efficient continuous operation in which the reactants are mixed in the reactor zone until the plating solution is formed. The plating solution is circulated to the electroplating zone between the electrodes, and the current applied to electrodeposit the aluminum. Then the solution is recirculated to the reactor zone, wherein aluminum is periodically replenished. One advantage of this two-stage system is the uniform plating because the uniformity of the solution can be closely regulated before passage to the electroplating zone. Also, any extraneous sludge which may form in the reactor zone can be filtered out before entering the electroplating zone.

EXPERIMENTAL SECTION AND EXAMPLES a. INTRODUCTION

The conductance and resistivity of the electrolytes were determined by using a YSI-3402 Platinum Conductivity Cell (Cell K=0.1).

In the analyses of the $[H^+]$, $[Al^{+3}]$, and $[Br^-]$ concentrations of the electrolytes, the following procedures were followed: In general, one ml. of electrolyte was decomposed into 2,500 ml. of distilled water using a pressure equalizing funnel and flask. The bromide concentration is determined directly using a bromide electrode (Orion Model 94035A) and an Orion pH meter, which gave readings in millivolts. By means of a standard bromide calibration curve and extrapolation, the millivolt readings were converted into molar concentrations. $[H^+]$ and $[Al^{+3}]$ concentrations were determined by titrating an aqueous solution of the electrolyte (1 ml. electrolyte /100 ml. $H_2O$) with a standard sodium hydroxide solution up to end points of pH, 3.00 and 11.00, respectively.

To test the plating quality of a particular electrolyte, and experimental cell was set up with the two electrodes in a 100 ml. beaker. The electrodes in the 100 ml. beaker comprised a teflon holder (8 cm. long, 3 cm. wide, and 1.5 cm. thick) provided with indentation and slit such that the Kovar cathode (Ni-Fe alloy) can be inserted into the Teflon holder at distances of 0.020 inch to 0.030 inch from the anode; and a porous graphite anode (6 cm. long, 3 cm. wide, and 1.5 cm. thick). Both the cathode and anode were at least 2 inches submerged into the electrolyte. Before each plating run, oxide was removed from the cathode by immersing the Kovar cathode into solutions of hot concentrated HCl, running hot water, cold concentrated HCl, and running cold water.

EX.1:PREPARATION OF TOLUENE-HYDROGEN BROMIDE-ALUMINUM BROMIDE ELECTROLYTES

The apparatus used in the preparation of these electrolytes consisted of a 2000 ml 3-neck round bottomed flask equipped with a reflux condenser connected to a gas trap, hydrogen bromide inlet tube, nitrogen inlet tube, magnetic stirrer, and water bath.

160 g. of 99.99% aluminum wire were cut into small pieces, and washed with aqueous 2 N potassium hydroxide, water (3 times), methanol (3 times) and toluene (3 times). Then, the aluminum was placed into the 2000 ml 3-neck round bottomed flask under an atmosphere of nitrogen. 760 ml. of reagent-grade toluene were added. Hydrogen bromide gas was bubbled into the mixture with stirring. The rate of addition of HBr was such that the temperature of the mixture did not rise above 30° C. After 15 to 30 minutes, the mixture turned yellow, then orange, and finally dark brown. Hydrogen bromide was bubbled into the mixture until approximately 95% of the solid aluminum have gone into solution. This took approximately 36 hours. Then the mixture was stirred under nitrogen at room temperature overnight to allow the system to reach equilibrium. The solution was decanted off, the total volume was measured, and the unreacted aluminum was collected and weighed. Hydrogen bromide gas was added slowly into the solution until the resistivity of the solution reached from 250 to 300 ohm-centimeters.

Using the analytical methods described above, the final plating solution contained the following parameters: The resistivity was 300 ohm-centimers; the $[H^+]$ concentration was less than 0.1 M; the $[Al^{+3}]$ concentration was 4.10M; and the $[Br^-]$ concentration was 12.75 M.

Using a cell containing electrodes set up in a 100 ml. beaker as described above, effective plating was achieved at a rate of 10 minutes, at voltage drops on the order of 2.2 volts and a current of 85 milliamperes. The reverse current etch before plating was for 1 minute at 2.0 volts and 60 milliamperes. The thickness of plating was 344 microinches. The current density was 36 mA/cm². The cathode efficiency was 100%.

Plating at a rate of 10 minutes, at voltage drops on the order of 3.0 volts, and a current of 195 milliamperes yielded 305 microinches of plated aluminum. The current density was 55 mA/cm². The cathode efficiency was 81%.

EX.2:PREPARATION OF ETHYL BROMIDE-TOLUENE-HYDROGEN BROMIDE-ALUMINUM BROMIDE ELECTROLYTES

The apparatus used in the preparation of these electrolytes consisted of a 2000 ml. 3-neck round bottomed flask equipped with a reflux condenser connected to a gas trap, hydrogen bromide inlet tube, nitrogen inlet tube, magnetic stirrer, and water bath.

160g 99.99% aluminum wire were cut into small pieces, and washed with aqueous 2N potassium hydroxide water (3 times), methanol (3 times), and toluene (3 times). Then the "cleaned" aluminum was placed into the reaction vessel under an atmosphere of nitrogen, and 760 ml. of reagent-grade toluene were added. Nitrogen was bubbled into the mixture with stirring for 10 minutes to purge the system free of oxygen and water vapor. With the nitrogen turned off, hydrogen bromide gas was bubbled into the mixture with stirring. Immediately, the mixture turned yellow; after 15 minutes it turned orange; and finally it turned dark brown. Hydrogen bromide treatment was continued until approximately 90% of the solid aluminum have gone into solution. This took approximately 36 hours. The rate of addition of HBr was maintained at such a rate that the temperature of the mixture did not rise above 30° C. Then the HBr was shut off and the mixture was stirred overnight at room temperature to allow the system to reach equilibrium. The solution was decanted into another 2,000 ml. 3-neck flask, and the unreacted aluminum was collected and weighed. HBr was bubbled into the solution to bring the hydrogen ion concentration up to 0.05 M with the resistivity at 750 ohm-centimeters.

a. 5 Mole % Ethyl Bromide — 95 Mole % Toluene System

Ethyl bromide (0.376 mole or 41.4g) was added dropwise with stirring to the above solution. Immediately HBr fumes evolved; and cooling with an ice bath was applied to keep the temperature of the mixture below 30° C. The mixture was stirred under nitrogen at room temperature for another 2 hours.

Using analytical procedures described above, this electrolyte contained the following parameters: The $[H^+]$ concentration was found to be 0.51 M. the $[Al^{+3}]$ concentration was 3.97 M, and the $[Br^-]$ concentration was 12.00 M. The resistivity of the solution was in the order of 250 ohm-centimeters.

Using a similar cell to that employed in PART I, effective plating was achieved at a rate of 10 minutes, at voltage drops on the order of 3.0 volts, and a current of 240 mA. Current density was 71 mA/cm²; and the thickness of plating was 266 microinches. The cathode efficiency was 46%.

b. 10 Mole % Ethyl Bromide — 90% Mole % Toluene System

Using a procedure described above in Section (a), ethyl bromide (0.376 mole or 41.4g) was added dropwise with stirring to the above 5 mole % ethyl bromide solution.

Using identical analytical procedures as described above, the $[H^+]$ concentration was found to be 0.71 M, the $[Al^{+3}]$ concentration was 3.83 M, and the $[Br^-]$ concentration was 12.25 M. The resistivity of the solution was 190 ohm/cm.

The plating was done using an experimental cell similar to that employed in Section (a), at a rate of 10 minutes, at voltage drops on the order of 3.0 volts, and a current of 250 mA. Current density was 87 mA/cm²; and the thickness of plating was 175 microinches. The cathode efficiency was 36%.

c. 15 Mole % Ethyl Bromide — 85 Mole % Toluene System

Using a procedure described above in Section (a) ethyl bromide (0.376 mole or 41.4g) was added dropwise with stirring to the above 10 mole % ethyl bromide solution.

Using identical analytical procedures as described above, the $[H^+]$ concentration was found to be 1.12 M, the $[Al^{+3}]$ concentration was 3.70 M, and the $[Br^-]$ concentration was 12.99 M. The resistivity of the solution was 165 ohm/cm.

The plating was performed using an experimental cell similar to that employed in Section (a), at a rate of 10 minutes, at voltage drops on the order of 3.0 volts, and a current of 210 mA. Current density was 77 mA/cm². The thickness of plating was found to be 125 microinches. The cathode efficiency was 30%.

d. 20 Mole % Ethyl Bromide — 80 Mole % Toluene System

Using a procedure described above in Section (a), ethyl bromide (0.376 mole or 41.4g) was added dropwise with stirring to the above 15 mole % ethyl bromide solution.

Using identical analytical procedures as described above, the $[H^+]$ concentration was found to be 1.48 M, the $[Al^{+3}]$ concentration was 3.73 M and the $[Br^-]$ concentration was 12.76 M. The resistivity of the solution was 155 ohm/cm.

The plating was performed using an experimental cell similar to that employed in Section (a), at a rate of 10 minutes, at voltage drops on the order of 3.0 volts, and a current of 225 mA. Current density was on the order of 83 mA/cm². The thickness of plating was discovered to be a bit thin, 62 microinches. The cathode efficiency was 21%.

e. 30 Mole % Ethyl Bromide — 70 Mole % Toluene System

Using a procedure described above in Section (a), ethyl bromide (0.75 mole or 82.8g) was added dropwise, with stirring to the above 20 mole % ethyl bromide solution.

Using identical analytical procedures as described above, the $[H^+]$ concentration was discovered to be 1.75 M, the $[Al^{+3}]$ concentration was 3.70 M, and the $[Br^-]$ concentration was 13.05 M. The resistivity of the solution was 205 ohm/cm.

Using an experimental cell similar to that employed in Section (a) above, plating was attempted at a rate of 10 minutes, at voltage drops on the order of 3.0 volts, and a current of 175 mA. The current density was 60 mA/cm². However, no plating was detected. The ethyl bromide and $[H^+]$ concentrations were too high for effective plating.

TABLE I

VARIATION OF CATHODE EFFICIENCY WITH ETHYL BROMIDE CONCENTRATIONS

| TRIAL I | | TRIAL II | |
|---|---|---|---|
| EtBr* (mole %) | Cathode Efficiency (%) | EtBr** (mole %) | Cathode Efficiency (%) |
| 5 | 46 | 5 | 35 |
| 10 | 36 | 10 | 24 |
| 15 | 30 | 13 | 18 |
| 20 | 21 | 15 | 0 |
| 30 | 0 | 20 | 0 |
| 40 | 0 | 30 | 0 |

*$[H^+]$ = 0.05 M Prior to Addition of EtBr.
**$[H^+]$ = 0.3 M Prior to Addition of EtBr.

The embodiments of the invention is which an exclusive property or privilege is claimed are defined as follows.

1. In a method for forming an electroplating solution for aluminum or its alloys, the step of reacting aluminum with a hydrogen halide in an aromatic hydrocarbon solvent and in the absence of water, to form a plating solution having an aluminum cation molarity, in a complex ion form, of below about 4.2 M, and a hydrogen ion molarity of below about 0.5 molarity whereby said plating solution has the ability to plate aluminum onto a cathode substrate at low voltages, on the order of below 3 volts, in the absence of an aluminum anode.

2. The method of claim 1 in which said aromatic hydrocarbon solvent is an alkyl benzene the alkyl group being selected from the group consisting of methyl and ethyl radicals.

3. The method of claim 1 in which the halide is selected from the group consisting of bromide, chloride and iodide.

4. The plating solution formed by the method of claim 1.

5. The method of claim 1 in which hydrogen halide or a source capable of generating the same under the conditions of reaction is supplied in a molar ratio with the aluminum of at least 3:1.

6. The method of claim 1 in which hydrogen halide or a source thereof capable of generation under the conditions of reaction is supplied in stoichiometric excess of the aluminum to form a plating soluble hydro aluminum halide cation in said plating solution.

7. The plating solution formed by the method of claim 6.

8. The method of claim 1 in which the said aluminum cation concentration present in said plating solution is maintained between about 3.0 M to about 4.2 M and the hydrogen ion molarity is maintained between about 0.01 M to about 0.5 M during plating.

9. The plating solution formed by the method of claim 8.

10. The method of claim 8 further characterized by a resistivity in said plating solution of from about 250 – 500 ohm centimeters.

11. The method of claim 1 wherein said aluminum cation concentration present in said plating solution is maintained between about 3.5 and 4.2 M and the hydrogen ion molarity is maintained below about 0.1 M during plating.

12. The method of Claim 1 wherein said aromatic hydrocarbon solvent is selected from the group consisting of benzene, toluene, xylene, ethyl benzene, diethyl benzene and mesitylene.

13. The method of claim 1 wherein an alkyl halide is added to said plating solution, in an amount of from about 5 – 20 mole percent of the amount of aromatic solvent in said plating solution, after said aluminum has reacted with hydrogen halide to form said aluminum cation.

14. The method of claim 13 wherein the alkyl group of said alkyl halide is selected from the group consisting of ethyl, methyl, n-propyl and isopropyl groups, and the halide is selected from the group consisting of bromide, chloride and iodide.

15. The method of claim 13 wherein said alkyl halide is ethyl bromide.

16. The method of claim 14 wherein the initial concentration of hydrogen halide just prior to the addition of said alkyl halide, is between about 0.05 M and 0.10 M.

17. The method of claim 14 wherein the aluminum cation concentration is between about 3.6 M to about 3.8 M.

18. In a method for forming an electroplating solution for aluminum, the step of reacting aluminum with hydrogen bromide in an aromatic hydrocarbon solvent and in the absence of water, to form a plating solution having an aluminum cation molarity, in a complex ion form, of between about 3.0 M and 4.2 M, and a hydrogen ion molarity of between about 0.01 M and 0.5 M whereby said plating solution has the ability to plate aluminum onto a cathode substrate at low voltages, on the order of below 3 volts, using an inert anode.

19. The plating solution formed by the method of claim 18.

20. The method of claim 18 in which said aromatic hydrocarbon solvent is an alkyl benzene.

21. The method of claim 1 which includes the steps of:

directing the plating solution formed in claim 1 into an electroplating zone having an inert anode and conductive cathode substrate to be plated; and applying an electrical potential between the anode and cathode to plate aluminum or its alloys from the substrate onto said cathode substrate.

22. The method of claim 18 which includes the steps of:

directing the plating solution formed in claim 18 into an electroplating zone having an inert anode and conductive cathode substrate to be plated; and applying an electrical potential between the anode and cathode to plate aluminum or its alloys from the substrate onto said cathode substrate.

23. The method of claim 1 in which a bromine getter is added to said plating solution, during the plating operation, in the region of said cathode substrate.

24. The method of claim 21 in which a bromine getter is added to said plating solution, during the plating operation, in the region of said cathode substrate.

25. The method of claim 22 in which a bromine getter is added to said plating solution, during the plating operation, in the region of said cathode substrate.

26. The method of claim 14 in which a bromine getter is added to said plating solution, during the plating operation, in the region of said cathode substrate.

27. The method of claim 18 wherein an alkyl halide is added to said plating solution, in an amount of from about 5 – 20 mole percent of the amount of aromatic solvent in said plating solution, after said aluminum has reacted with hydrogen halide to form said aluminum cation.

28. The method of claim 18 wherein the alkyl group of said alkyl halide is selected from the group consisting of ethyl, methyl, n-propyl and isopropyl groups, and the halide is selected from the group consisting of bromide, chloride and iodide.

29. The plating solution formed by the method of claim 27.

30. The method of claim 18 wherein the initial concentration of hydrogen halide just prior to the addition of said alkyl halide, is between about 0.05 M and 0.10 M.

31. The plating solution formed by the method of claim 13.

* * * * *